US009867443B2

(12) United States Patent
Kim et al.

(10) Patent No.: US 9,867,443 B2
(45) Date of Patent: Jan. 16, 2018

(54) TUBULAR CONTAINER HAVING APPLICATOR

(71) Applicant: YONWOO CO., LTD., Incheon (KR)

(72) Inventors: Sung-Hwan Kim, Incheon (KR); Curt Altmann, New York, NY (US); Eugene Dennison Kim, New York, NY (US); David Yi, New York, NY (US); Sung-Sin Kim, Incheon (KR)

(73) Assignee: YONWOO CO., LTD., Incheon (KR)

( * ) Notice: Subject to any disclaimer, the term of this patent is extended or adjusted under 35 U.S.C. 154(b) by 0 days.

(21) Appl. No.: 15/303,112

(22) PCT Filed: Mar. 31, 2015

(86) PCT No.: PCT/KR2015/003191
§ 371 (c)(1),
(2) Date: Oct. 10, 2016

(87) PCT Pub. No.: WO2015/156532
PCT Pub. Date: Oct. 15, 2015

(65) Prior Publication Data

US 2017/0208917 A1 Jul. 27, 2017

(30) Foreign Application Priority Data

Apr. 10, 2014 (KR) ..... 10-2014-0042951

(51) Int. Cl.
*A45D 34/04* (2006.01)
*A45D 40/26* (2006.01)
(Continued)

(52) U.S. Cl.
CPC ..... *A45D 34/04* (2013.01); *A45D 40/26* (2013.01); *B65D 51/24* (2013.01); *B65D 83/00* (2013.01)

(58) Field of Classification Search
CPC ..... A45D 34/04; A45D 40/26
(Continued)

(56) References Cited

U.S. PATENT DOCUMENTS 3,456,650 A * 7/1969 Schwartzman .... B65D 47/2075 215/260
5,454,494 A * 10/1995 Lechelle ..... B65D 35/46 222/494
(Continued)

FOREIGN PATENT DOCUMENTS

JP 2009-039509 A 2/2009
KR 20-0246281 Y1 10/2001
(Continued)

OTHER PUBLICATIONS

International Search Report issued PCT/KR2015/003191 dated Jul. 9, 2015.

*Primary Examiner* — Jennifer C Chiang
*Assistant Examiner* — Bradley Oliver
(74) *Attorney, Agent, or Firm* — Marshall, Gerstein & Borun LLP

(57) ABSTRACT

The present invention relates to a tubular container having an applicator, and the tubular container having an applicator according to the present invention is characterized in that an applicator made of metal and silicone, which contacts skin, is provided on the upper portion of the tubular container such that, when the contents thereof are applied to the skin, warmth or coldness can be transferred to the skin, thereby facilitating metabolism of the face skin and improving skin elasticity.

8 Claims, 5 Drawing Sheets

(a) (b)

(51) Int. Cl.
*B65D 83/00* (2006.01)
*B65D 51/24* (2006.01)

(58) Field of Classification Search
USPC ..... 401/186, 262, 263
See application file for complete search history.

(56) References Cited

U.S. PATENT DOCUMENTS 6,332,730 B1 * 12/2001 Taghavi-Khanghah ..... B65D 35/20 222/212
6,508,256 B2 * 1/2003 Byun ..... A45D 34/041 132/313
6,938,800 B1 * 9/2005 Lehmkuhl ..... B05B 11/047 222/153.14
8,066,153 B2 * 11/2011 Decottignies ..... B65D 83/0033 222/209
9,314,087 B2 * 4/2016 Ishida ..... A45D 40/26
2008/0257911 A1 * 10/2008 Choi ..... A45D 34/04 222/320
2009/0162132 A1 * 6/2009 Veasey ..... A45D 34/042 401/186
2015/0175314 A1 * 6/2015 Kim ..... B65D 47/2075 222/92
2015/0250292 A1 * 9/2015 Jung ..... A45D 40/26 401/26
2016/0095414 A1 * 4/2016 Debnath ..... B65D 35/36 401/266
2016/0192763 A1 * 7/2016 Cheng ..... B65D 47/42 401/265
2016/0249726 A1 * 9/2016 Jung ..... A45D 34/04 401/261
2017/0157377 A1 * 6/2017 Chang ..... A61M 35/003

FOREIGN PATENT DOCUMENTS

KR 2007-0037095 A 4/2007
KR 20-0441849 Y1 9/2008
KR 2011-0032887 A 3/2011

* cited by examiner

[Fig. 1]
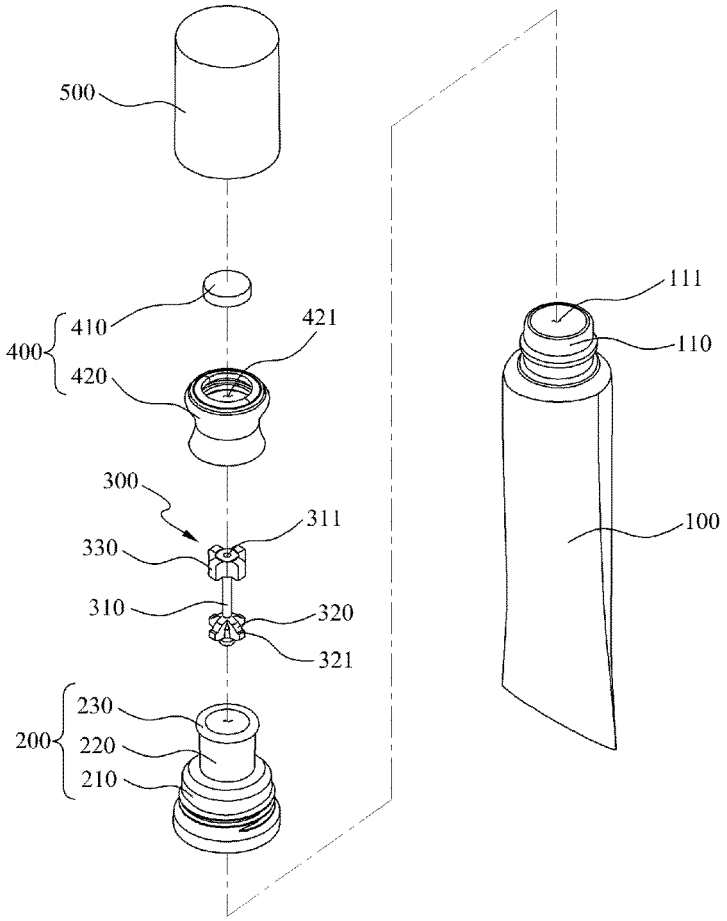
[Fig. 2]
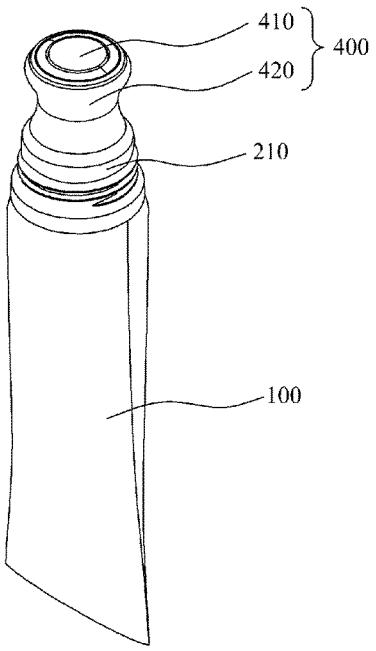

[Fig. 3]
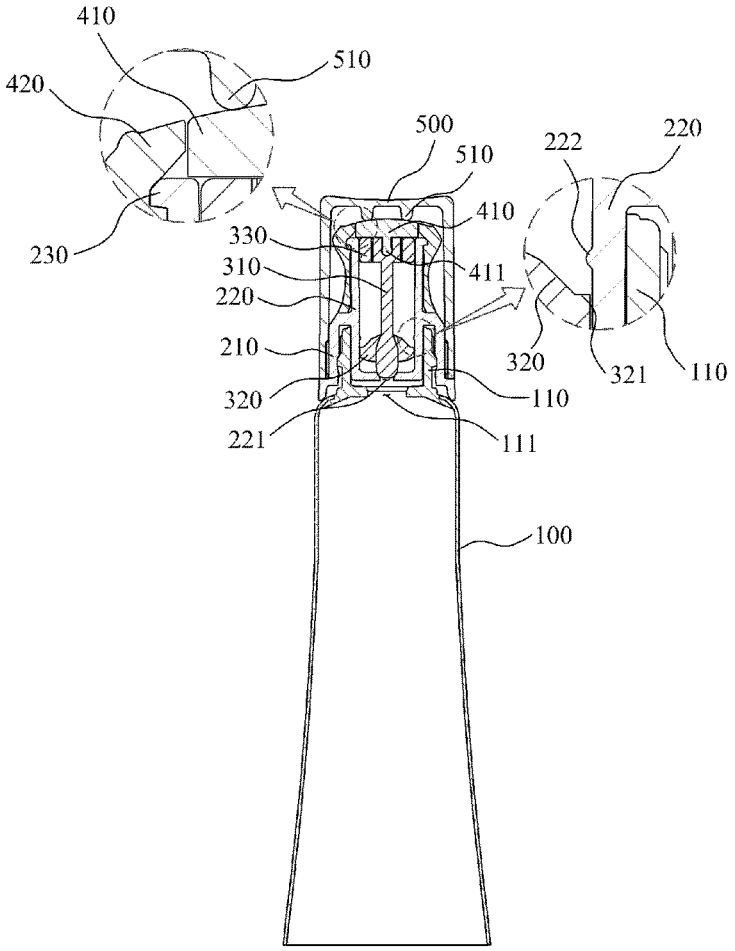
[Fig. 4]
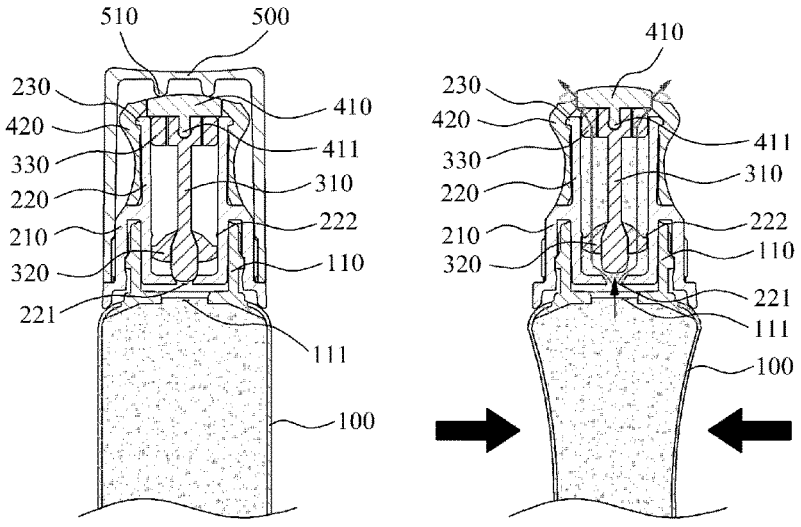
(a) (b)

[Fig. 5]
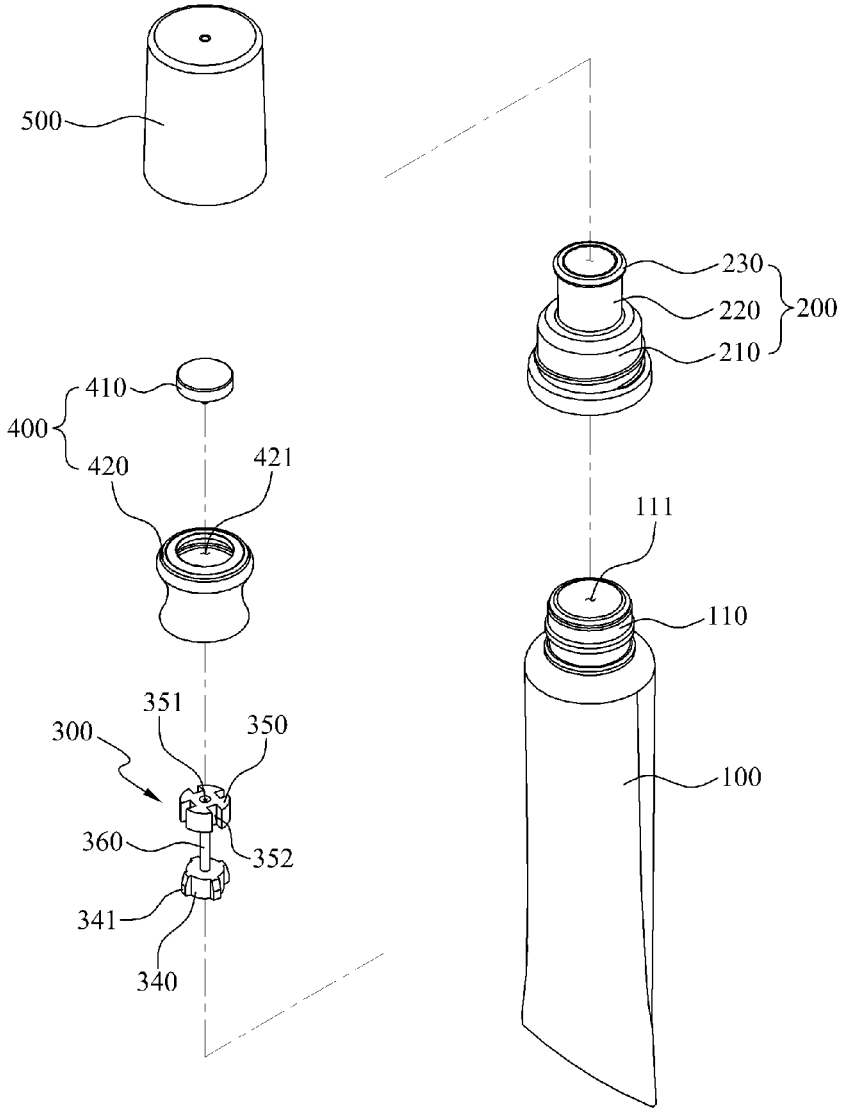

[Fig. 6]
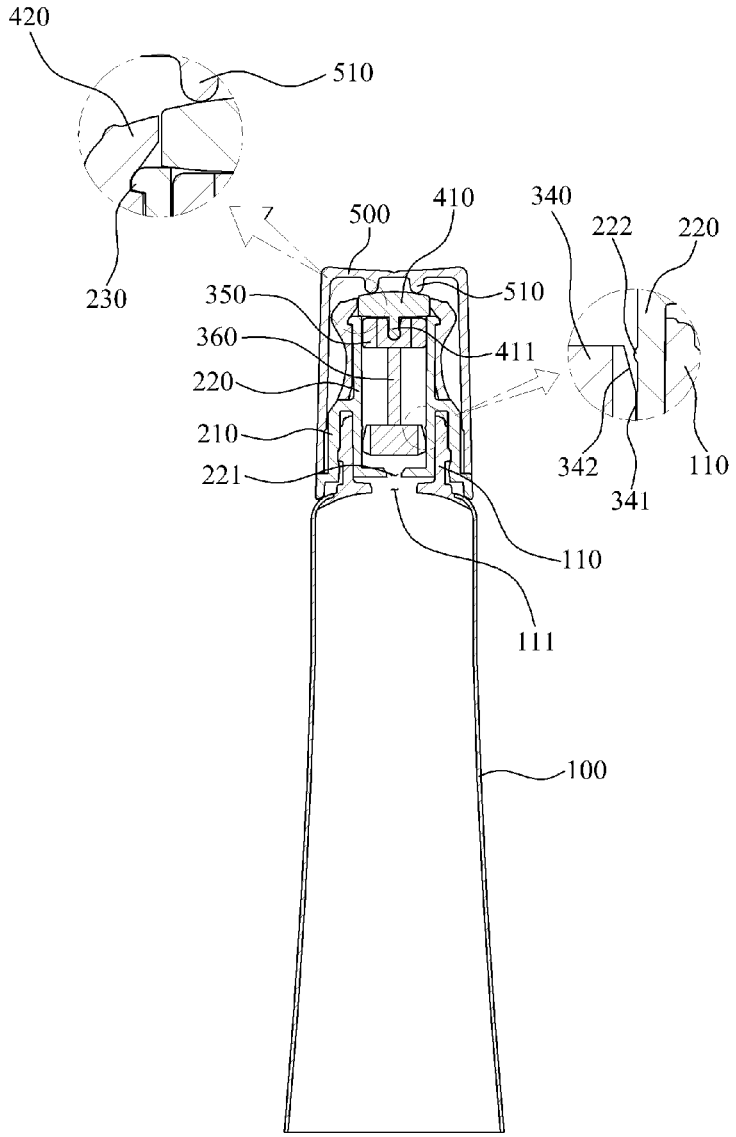

[Fig. 7]
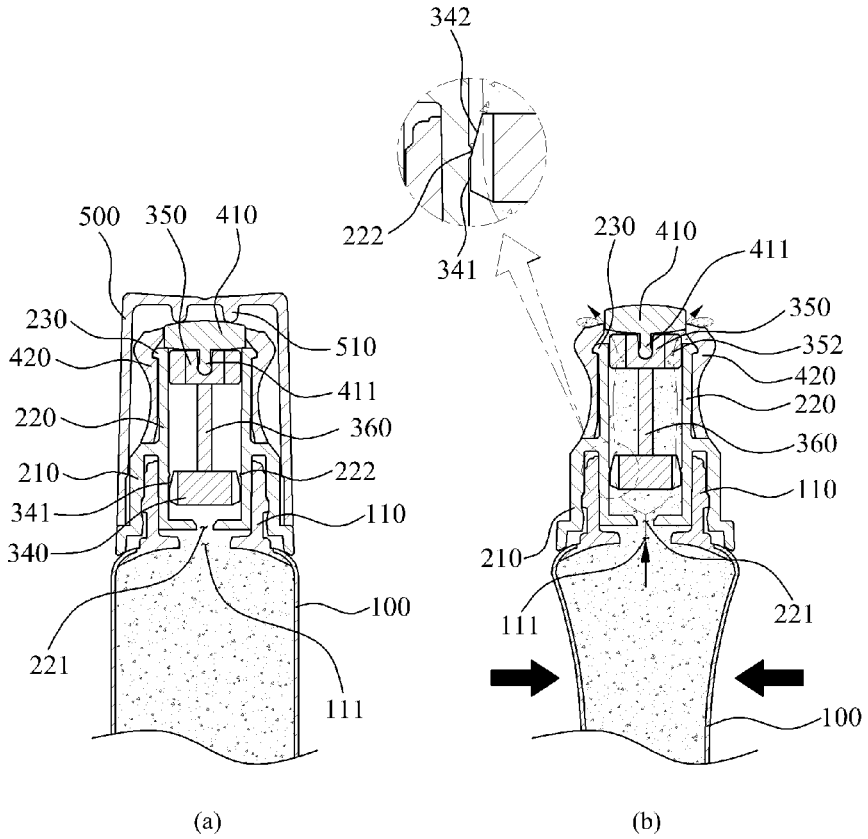

TUBULAR CONTAINER HAVING APPLICATOR

BACKGROUND OF THE INVENTION

The present invention disclosed herein relates to a tubular container having an applicator, wherein a tubular container having an applicator comprises an applicator disposed at an upper portion of the tubular container and made of metal material or silicon material that comes into contact with the skin, such that it is possible to transfer warmth and coldness to the skin when contents are applied, thereby promoting the metabolism and elasticity of the skin.

Generally, a tubular container having an applicator comprises a tube body receiving contents therein; a tube neck which is coupled to an upper portion of the tube body and supports the tube body, further comprising a discharging part to discharge content stored in the tube body; and an over cap which is detachably coupled to the tube neck and opens and closes the discharging part.

Tube containers as the above discharge contents through a discharging part when the tube body is pressurized, and as shown in FIG. 1 of the registered patent no. 10-1057333, have an applicator, like a brush which absorbs and discharges contents such that the contents can be applied easily, coupled to an upper portion structure (120).

Recently, as the interest in skincare increases, since it is hard to get enough amount of contents absorbed in the skin and contentable skincare effect by a simple absorption, there have been tried various methods to transfer warmth or coldness to the skin so as to promote the metabolism and improve elasticity of the skin. However, the registered patent above has a structure wherein contents are simply absorbed and discharged through a brush (140), and thus it is not possible to transfer warmth or coldness to the skin.

To solve the problems as the above, cold or hot mask packs are introduced such that warmth or coldness can be transferred to the skin. However, these devices are very complicated in their structures and takes a high manufacturing cost, and therefore, are not practically being used much.

Accordingly, there has increased a need for a cosmetic container having a simple structure which can transfer warmth or coldness to the skin when applying contents to the skin.

SUMMARY OF THE INVENTION

The present invention is devised to solve the said problems above, and its goal is to provide a tubular container having an applicator, wherein an applicator is disposed at an upper portion of the tubular container and made of metal material or silicon material that comes into contact with the skin, such that it is possible to transfer warmth and coldness to the skin when contents are applied, thereby promoting the metabolism and elasticity of the skin.

Furthermore, the tubular container having an applicator comprises an ascending and descending member which opens a content inflow hole when contents are discharged by pressurization of a tube body, and closes the content inflow hole when the contents are not discharged, such that it is possible to prevent air from flowing into the inside of the tube body through the content inflow hole in a normal state.

To solve such problems described in the above, a tubular container having an applicator according to the present invention comprises: a tube body receiving contents therein and coupled with a tube neck which has a discharging outlet at an upper portion thereof such that contents can be discharged; a support body coupled at an upper portion of the tube neck, comprising a content moving tube which is communicated with a discharging outlet, and forms a passage where contents discharged through the discharging outlet move and further forms a content inflow hole at a lower end thereof such that contents discharged through the discharging outlet can flow in; an ascending and descending member which ascends and descends inside the support body, and controls the contents flowing into the content moving tube; an applicator including a first applicator which is coupled to an upper portion of the ascending and descending member, and a second applicator which is coupled encasing an upper portion of the support body and forming a hollow so as to form a space where the first applicator ascends and descend, thereby coming into a contact to a user's skin and being able to apply contents onto the skin; and an over cap which is coupled, encasing the support body and the applicator, and forms a pressurizing protrusion which pressurizes an upper end of the first applicator at an inner side thereof.

Furthermore, it is featured that the first applicator is made of metal material and the second applicator is made of silicon material.

Furthermore, it is featured that the support body further comprises a fixing part which is coupled encasing the tube neck and fixes the support body to the tube neck; a content moving tube which is communicated with the discharging outlet, and comprises a passage through which the contents discharged through the discharging outlet moves, and further comprises a content inflow hole at a lower end thereof such that the contents moving through the discharging outlet can flow in; and a supporting protrusion which is protrusively formed at an upper end of the content moving tube, encasing an outer circumferential surface, and supports the second applicator.

Furthermore, it is featured that an ascent limiting protrusion is formed at an inner side of the content moving tube to limit the ascent of the ascending and descending member.

Furthermore, it is featured that the ascending and descending member comprises an opening and closing rod which opens or closes the content inflow hole; a first twist-preventing protrusion which is formed with a predetermined distance apart, encasing a lower portion of an outer circumferential surface, and thus prevents the twist of the ascending and descending member while ascending or descending in a state of being tightly contacted to an inner wall of the content moving tube; and a second twist-preventing protrusion which is formed with a predetermined distance apart, encasing an upper portion of an outer circumferential surface, and thus prevents the twist of the ascending and descending member while ascending or descending in a state of being tightly contacted to an inner wall of the content moving tube.

Furthermore, it is featured that the first twist-preventing protrusion has a securing protrusion which meets a lower end of the ascent-limiting protrusion when the ascending and descending member ascends, and limits the ascent of the ascending and descending member.

Furthermore, it is featured that the ascending and descending member comprises a base support body which is disposed at an inner lower portion of the content moving tube, wherein a guide protrusion comes to a close contact with an inner wall of the content moving tube at an outer circumferential surface and guides a perpendicular movement of the ascending and descending member, such that a passage which contents moves through is formed with a predetermined distance apart; and a connecting rod which is disposed between the base support body and the upper portion support body and connects the base support body and the upper portion support body.

Furthermore, it is featured that the guide protrusion meets a lower end of the ascent limiting protrusion and limits the ascent of the ascending and descending member when the ascending and descending member ascends, further comprising an inclined plane which gets narrower towards an upper portion thereof, such that the ascending and descending member is not interfered with the ascent limiting protrusion during an ascending process of the ascending and descending member.

As described above, the present invention is provided with an applicator made of metal material or silicon material which comes into a contact with the skin, such that it is possible to transfer warmth and coldness to the skin when contents are applied, thereby promoting the metabolism and elasticity of the skin.

Furthermore, when the contents are discharged by pressurizing the tube body, the ascending and descending member opens the content inflow hole whereas the ascending and descending member closes the content inflow hole when the contents are not discharged, which can prevent air from flowing into the inside of the tube body through the content inflow hole in a normal state.

Furthermore, it is configured that in a state of the over cap being coupled to the support body, the first applicator is pressurized by the pressurizing protrusion of the over cap and closes an opened upper end of the content moving tube, and thus it is possible to prevent the leakage of contents received in the content moving tube.

BRIEF DESCRIPTION OF THE DRAWINGS

FIG. 1 is an exploded perspective view illustrating a configuration of a tubular container having an applicator according to an exemplary embodiment of the present invention.

FIG. 2 is an assembled perspective view illustrating a configuration of a tubular container having an applicator according to an exemplary embodiment of the present invention.

FIG. 3 is a cross-sectional view illustrating a configuration of a tubular container having an applicator according to an exemplary embodiment of the present invention.

FIG. 4 is a view illustrating an operational state of contents being discharged of a tubular container having an applicator according to an exemplary embodiment of the present invention.

FIG. 5 is an exploded perspective view illustrating a configuration of a tubular container having an applicator according to another exemplary embodiment of the present invention.

FIG. 6 is a cross-sectional view illustrating a configuration of a tubular container having an applicator according to another exemplary embodiment of the present invention.

FIG. 7 is a view illustrating an operational state of contents being discharged of a tubular container having an applicator according to another exemplary embodiment of the present invention.

DETAILED DESCRIPTION OF PREFERRED EMBODIMENTS

Hereinafter, exemplary embodiments of the present invention will be described in detail with reference to the accompanying drawings. The same reference numerals provided in the drawings indicate the same members.

FIG. 1 is an exploded perspective view illustrating a configuration of a tubular container having an applicator according to an exemplary embodiment of the present invention. FIG. 2 is an assembled perspective view illustrating a configuration of a tubular container having an applicator according to an exemplary embodiment of the present invention. FIG. 3 is a cross-sectional view illustrating a configuration of a tubular container having an applicator according to an exemplary embodiment of the present invention.

Referring to FIGS. 1 to 3, a tubular container having an applicator according to an exemplary embodiment of the present invention may include a tube body 100, a support body 200, an ascending and descending member 300, an applicator 400, and an over cap 500.

The tube body 100 receiving contents is coupled with a tube neck 110 at an upper portion thereof such that the tube neck 110 can support the tube body 100 and a support body 200 to be described later can be coupled, wherein the tube neck has a discharging outlet 111 at a center thereof such that contents received in the tube body 100 can be discharged.

The support body 200 coupled to an upper portion of the tube neck 110 supports an applicator 300, and comprises a passage which the contents discharged through the discharging outlet 111 move through, further comprising a fixing part 210, a content moving tube 220, and a supporting protrusion 230.

The fixing part 210 is coupled at a lower portion of the support body 200, encasing the tube neck 110, and fixes the support body 200 to the tube neck 110. It is preferred that a fixing means is provided such that the support body 200 can be prevented from moving upwards and being detached in a state of being coupled to the tube neck 110.

The content moving tube 220 is communicated with the discharging outlet 111 and longitudinally forms a passage such that the contents discharged through the discharging out 111 are able to move upwards, and at a lower center portion thereof is provided a content inflow hole 221 such that the contents discharged through the discharging outlet 111 can flow in.

The present invention has a feature in that an ascent limiting protrusion 222 is provided at an inner side of the content moving tube 220 so as to limit the ascent of an ascending and descending member 300 which ascends and descends inside the content moving tube 220. Due to this, when the contents are discharged by pressurizing the tube body 100, the ascending and descending member 300 which ascends by the pressure of the contents can be prevented from being detached from the content moving tube 220.

The supporting protrusion 230 is protrusively formed, encasing an outer circumferential surface at an end of the content moving tube 220, and is coupled with a second applicator 420, thereby supporting the second applicator 420.

The ascending and descending member 300 ascends and descends inside the content moving tube 220 of the support body 200, and opens and closes the content inflow hole 221, further comprising an opening and closing rod 310, a first twist-preventing protrusion 320, and a second twist-preventing protrusion 330.

The opening and closing rod 310 is disposed directly above the content inflow hole 221, and opens and closes the content inflow hole 221 by an ascending and descending operation of the ascending and descending member 300. At a normal state, the opening and closing rod 310 is disposed with the content inflow hole 221 being closed; meanwhile, when a user pressurizes the tube body 100, the opening and closing rod 310 ascends to an upward direction by a pressure of the contents and opens the content inflow hole 221.

Meanwhile, at an upper end of the opening and closing rod 310 is provided a coupling groove 311 to which a first applicator 410 is coupled such that the first application 410 can move along together when the ascending and descending member 300 ascends and descends.

The first twist-preventing protrusion 320 provided with a predetermined distance apart and encasing a lower outer circumferential surface of the opening and closing rod 310 ascends and descends in a state of being tightly contacted to an inner wall of the content moving tube 220, thereby preventing the ascending and descending member 300.

In the present invention, the first twist-preventing protrusion 320 has a securing protrusion 321 which meets a lower end of the ascent limiting protrusion 222 when the ascending and descending member 300 ascends, such that the securing protrusion 321 is supported at a lower end of the ascent limiting protrusion 222 and limits the ascent of the ascending and descending member 300, thereby preventing the ascending and descending member 300 from be detached from the content moving tube 220.

The second twist-preventing protrusion 330, which is formed with a predetermined distance apart and encasing an upper outer circumferential surface of the opening and closing rod 310, ascends and descends in a state of being tightly contacted to an inner wall of the content moving tube 220, and thereby prevents the twist of the ascending and descending member 300.

The applicator 400 is contacted to a user's skin and applies contents to the skin, comprising a first applicator 400 which is coupled to a coupling groove 311 of the opening and closing rod 310 at an upper portion of the ascending and descending member 300, and a second applicator 420 which is coupled encasing an upper portion of the support body 200, and forms a hollow 421 such that the first applicator 410 can forms a space where the first applicator 410 ascends and descends.

The present invention has a feature in that the applicator 400 has a first applicator 410 made of metal material and a second applicator 420 made of silicon material. Due to this, it is possible to transfer warmth or coldness to the skin when applying contents to the skin.

For example, when a first applicator 410 made of metal material is cold, a second applicator 420 made of silicon material will relatively transfer warmth to the skin. Therefore, when the first applicator 410 and the second applicator 420 are contacted to user's skin simultaneously, warmth and coldness can be transferred at the same time, thereby promoting the metabolism and elasticity of the skin.

Meanwhile, the first applicator 410 is configured to be pressurized by the pressurizing protrusion 510 of an over cap 500 in a state of the over cap 500 being coupled to a support body 200 and then close an upper end of the content moving tube 220 which is opened, thereby preventing a leakage of the contents stored in the content moving tube 220.

The over cap 500 is coupled to the support body 200, encasing the support body 200 and the applicator 400, and includes a pressurizing protrusion 510 which is protrusively formed in a downward direction at an inner upper end thereof and pressurizes an upper end of the first applicator 400.

The pressurizing protrusion 510 pressurizes an upper end of the first applicator 410 in a state of the over cap 500 being coupled to the support body, and prevents the ascending and descending member 300 from ascending. At the same time, the pressurizing protrusion 510 causes the opening and closing rod 310 to close the content inflow hole 221. Therefore, at a normal state, air can be prevented from flowing into the inside of the tube body 100 and thereby the contents stored in the tube body 100 is prevented from being spoiled.

Hereinafter, referring FIG. 4, an operational state of contents being discharged of a tubular container having an applicator according to an exemplary embodiment of the present invention will be described. FIG. 4 is a view illustrating an operational state of contents being discharged of a tubular container having an applicator is discharged according to an exemplary embodiment of the present invention.

Referring FIG. 4, in a tubular container having an applicator according to an exemplary embodiment of the present invention, when a user pressurizes a tube body 100, the contents received in the tube body 100 move to an upper portion thereof through a discharging outlet 111. At this time, an ascending and descending member 300 ascends by the pressure of the contents, an opening and closing rod 310 is detached from a content inflow hole 221, and the content inflow hole 221 is opened, and thereby the contents flow in through the content inflow hole 221 which is opened.

When the ascending and descending member 300 ascends as the above, a first applicator 410 coupled at an upper portion thereof ascends along with, and thereby contents are discharged through a space formed by the first applicator 410 and the second applicator 420.

Next, when the contents are discharged to an upper end of the applicator 400, it is possible to apply the contents onto the skin through the applicator 400. At this time, the first applicator 410 and the second applicator 420 which are made of metal material and silicon material respectively will provide a user with coldness and relative warmth. In other words, it is possible to provide coldness and warmth to the skin at the same time, thereby promoting the metabolism and elasticity of the skin.

Hereinafter, another exemplary embodiment of the present invention will be described in detail with reference to FIGS. 5 and 6. FIG. 5 is an exploded perspective view illustrating a configuration of a tubular container having an applicator according to another exemplary embodiment of the present invention. FIG. 6 is a cross-sectional view illustrating a configuration of a tubular container having an applicator according to another exemplary embodiment of the present invention.

Hereinafter, referring FIGS. 5 and 6, a tubular container having an applicator according to another exemplary embodiment of the present invention includes a tube body 100, a support body 200, an ascending and descending member 300, an applicator 400 and an over cap 500.

Since the tube body 100, the support body 200, the applicator 400, and the over cap 500 are the same as an exemplary embodiment of the present invention previously described, detailed description will be omitted. Instead the ascending and descending member 300 will be explained in detail.

The ascending and descending member 300 disposed at an inner lower portion of a content moving tube 220 of the support body 200 and controlling the discharge of the contents flowing into the content moving tube 220 includes a base support body 340, an upper portion support body 350, and a connecting rod 360.

The base support body 340 disposed at an inner lower portion of the content moving tube 220 includes a multitude of guide protrusions 341 formed with predetermined distance apart which are closely contacted with an inner wall of the content moving tube 220 at an outer circumferential surface thereof and guide a perpendicular movement, wherein the guide protrusion 341 ascends and descends in a state of being closely contacted with an inner wall of the content moving tube 220, thereby preventing the twist of the ascending and descending member 300.

The guide protrusion 341 has a multitude thereof with a predetermined distance apart, and thereby forms a passage where the contents having flowed into the content moving tube 220 can move to an upper portion thereof.

The present invention has a feature in that the guide protrusion 341 meets a lower end of an ascent limiting protrusion 222 and limits the ascent of the ascending and descending member 300 when the ascending and descending member 300 ascends. To prevent interference with the ascent limiting protrusion 222 during a process that the ascending and descending member 300 rises, an inclined plane 342 that gets narrower towards the upper portion is provided. By limiting the ascent of the ascending and descending member 300 at the point where a dead end of the inclined plane 342 meets the ascent limiting protrusion 222, the ascending and descending member 300 can be prevented from being detached from the content moving tube 220.

The upper portion support body 350 is ascended and descended at an inner upper portion of the content moving tube 220 in a state of being tightly contacted to an inner wall of the content moving tube 220. The present invention has a feature in that a coupling groove 351 where a first applicator 410 is coupled is provided at an upper end of the upper portion support body 350.

The upper portion support body 350 is coupled with a first applicator 410 through the coupling groove 351 and make it possible that the first applicator 410 can move along when the ascending and descending member 300 ascends and descends. Due to this, at a normal state, the first applicator 410 closes the opened upper end of the content moving tube 220 and thereby prevents the contents from being discharged. Meanwhile, when the ascending and descending member 300 ascends by pressure of the contents, the first applicator 410 causes the opened upper end of the content moving tube 220 to open and the contents to be discharged through a space formed by the first applicator 410 and the second applicator 420.

Meanwhile, at an outer circumferential surface are provided a multitude of content moving grooves 352 with a predetermined distance apart such that the contents having flowed into the content moving tube 220 can move to the upper portion thereof.

The connecting rod 360 is disposed between the base support body 340 and the upper portion support body 350, and connects the base support body 340 and the upper portion support body 350.

Hereinafter, another exemplary embodiment of the present invention will be described in detail with reference to FIG. 7. FIG. 7 is a view illustrating an operational state of contents being discharged of a tubular container having an applicator according to another exemplary embodiment of the present invention.

Referring to FIG. 7, a tubular container having an applicator according to another exemplary embodiment of the present invention has a feature in that at first, when a user pressurizes a tube body 100, the contents stored in the tube body 100 moves to the upper portion thereof through a discharging outlet 111 and flows into the content moving tube 220 through the content inflow hole 221. At this time, the pressure of the contents causes an ascending and descending member 300 to rise.

When the ascending and descending member 300 rises as the above, a first applicator 410 coupled to an upper portion of the ascending and descending member 300 rises along with. Due to this, an opened upper end of the content moving tube 220 is opened, and the contents having flowed into the content moving tube 220 will move to the upper portion thereof through a content moving groove 352 and be discharged through a space formed by a first applicator 410 and a second applicator 420.

At this time, the ascending and descending member 300 continues to rise until the moment when a guide protrusion 341 meets a lower end of an ascent limiting protrusion 222. Therefore, the guide protrusion 341 is supported by the ascent limiting protrusion 222 and prevents the ascending and descending member 300 from being detached from the content moving tube 220.

Meanwhile, when contents are discharged to an end of the applicator 400 as the above, it is possible to apply the contents onto the skin through the application 400. At this time, the first applicator 410 and the second applicator 420 which are made of metal material and silicon material respectively will provide a user for coldness and relative warmth. In other words, it is possible to provide coldness and warmth to the skin at the same time, thereby promoting the metabolism and elasticity of the skin.

As described above, optimal embodiments have been disclosed in the drawings and the specification. Although specific terms have been used herein, these are only intended to describe the present invention and are not intended to limit the meanings of the terms or to restrict the scope of the present invention as disclosed in the accompanying claims. Therefore, those skilled in the art will appreciate that various modifications and other equivalent embodiments are possible from the above embodiments. Therefore, the scope of the present invention should be defined by the technical spirit of the accompanying claims.

What is claimed is:

1. A tubular container having an applicator comprising:

a tube body receiving contents, and at an upper portion thereof, coupled with a tube neck having a discharging outlet where contents are discharged;

a support body coupled to an upper portion of the tube neck, and communicated with the discharging outlet and forming a passage where contents discharged through the discharging outlet move into, further comprising a content moving tube having a content inflow hole such that the contents discharged through the discharging outlet can flow in;

an ascending and descending member ascending and descending at an inner side of the support body and controlling a discharging of the contents which flow into the content moving tube;

an applicator which applies contents in a close contact with the skin by comprising a first applicator which is coupled to an upper portion of the ascending and descending member, and a second applicator which is coupled encasing an upper portion of the support body and forms a hollow so as to form a space where the first applicator can ascend and descend; and an over cap coupled, encasing the support body and the applicator, and comprising a pressurizing protrusion which pressurizes an upper end of the first applicator at an inner side thereof.

2. The tubular container having an applicator of claim 1, wherein the first applicator is made of metal material and the second applicator is made of silicon material.

3. The tubular container having an applicator of claim 1, wherein the support body further comprising:

a fixing part coupled thereto, encasing the tube neck and fixing the support body to the tube neck; and a support protrusion protrusively coupled at an upper end of the content moving tube, encasing an outer circumferential surface, and supporting the second applicator.

4. The tubular container having an applicator of claim 1, wherein an ascent limiting protrusion is provided, encasing an outer circumferential surface at an upper end of the content moving tube, and supports the second applicator.

5. The tubular container having an applicator of claim 4, wherein the ascending and descending member comprises:

an opening and closing rod which opens and closes the content inflow hole;

a first twist-preventing protrusion which is formed with a multitude thereof in a predetermined distance apart, encasing a lower outer circumferential surface of the opening and closing rod, and ascends and descends in a state of being tightly contacted to an inner wall of the content moving tube; and a second twist-preventing protrusion which is formed with a multitude thereof in a predetermined distance apart, encasing an upper outer circumferential surface of the opening and closing rod, and ascends and descends in a state of being tightly contacted to an inner wall of the content moving tube.

6. The tubular container having an applicator of claim 5, wherein the first twist-preventing protrusion comprises a securing protrusion which meets the lower end of the ascent limiting protrusion and limits the ascent of the ascending and descending member.

7. The tubular container having an applicator of claim 4, wherein the ascending and descending member comprises:

a base support body disposed at an inner lower side of the content moving tube, wherein a guide protrusion, which guides a perpendicular movement of the ascending and descending member in a close contact with an inner wall of the content moving tube at an outer circumferential surface thereof, is formed with a predetermined distance apart and forms a passage where contents move;

an upper portion support closely contacted to an inner wall of the content moving tube at an inner upper portion of the content moving tube, comprising a coupling groove which is coupled with the first applicator at an outer circumferential surface thereof, and a content moving hole which is formed with a multitude thereof in a predetermined distance apart at an outer circumferential surface thereof such that contents having flowed into the content moving tube can move to an upper portion thereof; and a connecting rod disposed between the base support body and the upper portion support body, and connects the base support body and the upper portion support body.

8. The tubular container having an applicator of claim 7, wherein the guide protrusion meets a lower end of the ascent limiting protrusion and limits the ascent of the ascending and descending member when the ascending and descending member ascends, further comprising an inclined plane which gets narrower towards an upper portion thereof, such that the ascending and descending member is not interfered with the ascent limiting protrusion during an ascending process of the ascending and descending member.

* * * * *